US009802203B2

(12) United States Patent
Voltolini

(10) Patent No.: US 9,802,203 B2
(45) Date of Patent: Oct. 31, 2017

(54) SIZE REDUCTION DEVICE AND METHOD FOR THE SIZE REDUCTION OF SOLID PARTICLES

(71) Applicant: NETZSCH Pumpen & Systeme GmbH, Selb (DE)

(72) Inventor: Rafael Voltolini, Jaragua do Sul (BR)

(73) Assignee: NETZSCH Pumpen & Systeme GmbH, Selb (DE)

( * ) Notice: Subject to any disclaimer, the term of this patent is extended or adjusted under 35 U.S.C. 154(b) by 496 days.

(21) Appl. No.: 14/483,604

(22) Filed: Sep. 11, 2014

(65) Prior Publication Data

US 2015/0069154 A1 Mar. 12, 2015

(30) Foreign Application Priority Data

Sep. 11, 2013 (DE) ..... 10 2013 109 956

(51) Int. Cl.

| | |
|---|---|
| ***B02C 23/36*** | (2006.01) |
| ***B02C 18/00*** | (2006.01) |
| ***B02C 18/06*** | (2006.01) |
| ***B02C 18/14*** | (2006.01) |
| *B02C 18/18* | (2006.01) |

(52) U.S. Cl.

CPC ..... *B02C 23/36* (2013.01); *B02C 18/0092* (2013.01); *B02C 18/06* (2013.01); *B02C 18/142* (2013.01); *B02C 2018/188* (2013.01)

(58) Field of Classification Search

CPC ... B02C 23/36; B02C 18/142; B02C 18/0092; B02C 18/06; B02C 2018/188

USPC ..... 241/46.06

See application file for complete search history.

(56) References Cited

U.S. PATENT DOCUMENTS 4,046,324 A * 9/1977 Chambers ..... B02C 18/0092 241/236
4,702,422 A * 10/1987 Chambers, Sr. .... B02C 18/0092 241/236
5,160,095 A 11/1992 Pepper

FOREIGN PATENT DOCUMENTS

DE 3782387 T2 4/1993

* cited by examiner

*Primary Examiner* — Mark Rosenbaum
(74) *Attorney, Agent, or Firm* — Whitmyer IP Group LLC

(57) ABSTRACT

A size reduction device and method for solid particles, which are conveyed as a suspension in a liquid flow. The device includes a housing, at least two counter-rotatable size reduction components disposed in the housing, each including a plurality of cutting elements, disposed on a common rotatable shaft with a longitudinal axis. The flow direction of the suspension is at right angles to the longitudinal axes of the shafts of the size reduction components. Two mutually opposite guide rails with a longitudinal axis parallel to the shafts are assigned to components. Each guide rail includes a base plate, on which ribs with channels are constituted parallel to the flow direction on the side of the base plate towards the component.

12 Claims, 7 Drawing Sheets

(Prior art)
Fig. 1A
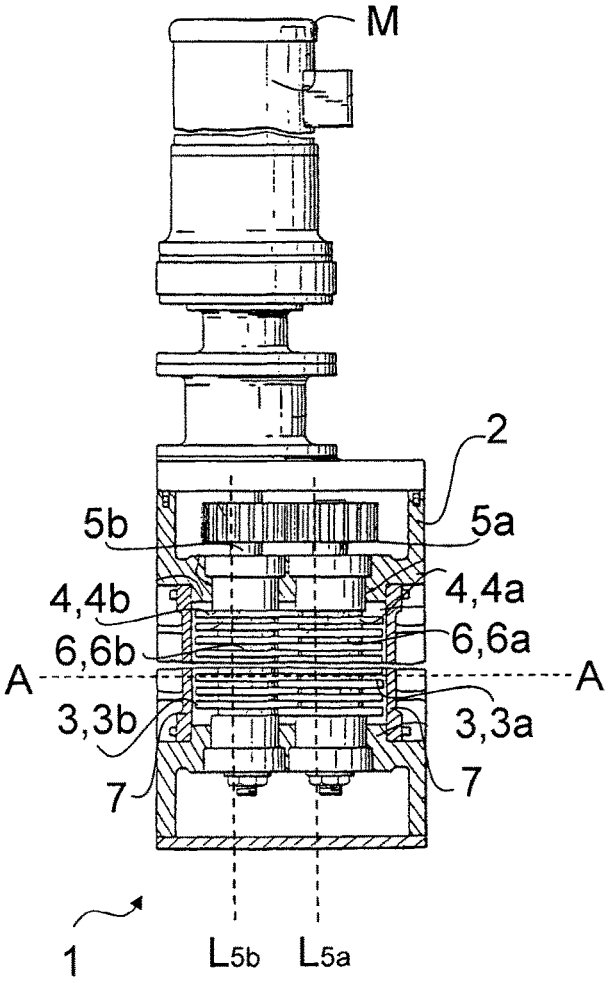
Fig. 1B
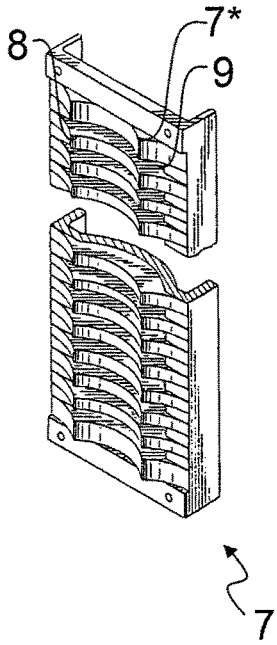
A-A
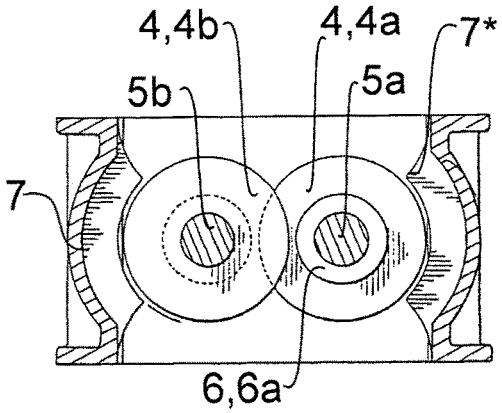
Fig. 1C

SIZE REDUCTION DEVICE AND METHOD FOR THE SIZE REDUCTION OF SOLID PARTICLES

FIELD OF THE INVENTION

The invention relates to a size reduction device and a method for the size reduction of solid particles.

BACKGROUND OF THE INVENTION

The invention relates to a size reduction device, which is used in particular for the (preliminary) size reduction of materials to be pumped, for example for the size reduction of materials which are transported by means of an eccentric screw pump or suchlike. Such size reduction devices are used for example in biogas installations, sewage treatment plants etc., in order to perform a preliminary size reduction of coarse components in waste water or suchlike to a pumpable size.

DE 3782387 T2 describes a device for the size reduction of solid waste material. The solid waste material is introduced into the intermediate space of counter-rotating, intermeshed cutting elements. In particular, they are cutting discs with the radially projecting cutting teeth. The solid material is preferably conveyed with a liquid through the counter-rotating arrangement of cutting elements. The document also describes guide rails, which extend parallel to the flow direction of the liquid and comprise a plurality of fingers arranged in parallel, between which slots are constituted. The spacing between the fingers is so small that the flow passage arising between them prevents the passage of non-size-reduced waste material, but permits the passage of small particles of the solid waste with the through-flowing liquid. The flow-rate of the liquid is thus increased and at the same time the size reduction effect is increased.

U.S. Pat. No. 5,160,095 describes a size reduction device for solids or for solids suspended in solution. The latter comprises two stacks of counter-rotating cutting discs, which preferably comprised teeth as cutting means. The two stacks of cutting discs are disposed between two side rails. Each of the side rails comprises a plurality of ribs, recesses being constituted in each case between the ribs. The ribs and recesses are disposed at an angle with respect to the planes of the cutting discs, so that two or more cutting discs run past each rib. In particular, the teeth of the at least two cutting discs are positioned so close to the respective rib that good size reduction of each solid that is conveyed by liquid through the recesses between the ribs is achieved. In particular, the maximum size of the solids passing through can be precisely controlled with the arrangement without a reduction in the flow velocity.

The problem of the invention consists in achieving a particularly uniform size reduction of solid particles that is improved compared to the prior art in order to protect following devices, wherein in particular no larger particles are allowed to pass through the size reduction device without undergoing size reduction.

The aforementioned problem is solved by a size reduction device and a method for the size reduction of solid particles in accordance with the invention.

SUMMARY OF THE INVENTION

The invention relates to a size reduction device for solid particles. The solid particles are conveyed as a suspension in a liquid flow through the size reduction device. That is to say that the solid particles are either already present in a suspension, for example as waste water in a sewage treatment plant or suchlike. Or the solid particles are suspended in water or another suitable liquid and then conveyed through the size reduction device.

The size reduction device comprises a housing which is at least partially open at opposite sides for the purpose of introducing and discharging the suspension in a flow direction. At least two counter-rotatable size reduction means are disposed in the housing. Each size reduction means preferably comprises a plurality of cutting elements, which are each disposed on a common rotatable shaft. Each of the rotatable shafts has a longitudinal axis, wherein the longitudinal axes are disposed parallel to one another. In particular, the cutting elements are constituted as cutting discs, comparable to saw blades of a circular saw, and in each case separated from one another by spacer elements. The spacer elements preferably have the same thickness as the cutting discs, so that the spacer elements of the first size reduction means lie in the same plane as the cutting discs of the second size reduction means. A cutting disc of the first size reduction means thus forms, together with the spacer element of the second size reduction means, a pair of size reduction elements operating with one another.

The flow direction of the suspension is normal to the longitudinal axes of the shafts of the size reduction means, so that the solid particles entrained in the suspension are preferably conveyed between the at least two size reduction means.

Furthermore, two mutually opposite guide rails parallel to the longitudinal axis of the shafts of the size reduction means are assigned to the size reduction means. Each of the guide rails comprises a base plate. Ribs with channels lying in between are constituted parallel to the flow direction on the side of the base plate that points towards the respectively adjacent size reduction means. The suspension can pass through these channels as long as the solid particles entrained therein do not exceed a maximum size predetermined by the width of the channel. By means of the guide rail, solid particles which exceed a maximum size predetermined by the channel size are in particular prevented from being conveyed at the side past the size reduction means without having undergone size reduction. Instead, these large solid particles are forced back again into a central suspension flow and are conveyed between the at least two size reduction means and thereby undergo size reduction.

According to the invention, the ribs and therefore the channels constituted between the latter each cover only at least a partial region of the width of the guide rails.

According to a particularly preferred embodiment, the ribs each comprise two aligned partial ribs. Constituted between the aligned partial ribs is a central, essentially unstructured intermediate region. A valley between the totality of the aligned partial ribs of a guide rail is thus constituted in particular in the central region of the guide rails parallel to the longitudinal axes of the shafts of the size reduction means. In particular, the valley bottom comprises an unstructured region without ribs or partial ribs and channels constituted between the latter, in which region a second size reduction process of small solid particles takes place.

According to an embodiment, the suspension in the largely unstructured partial region of the width of the guide rails that is not covered by ribs can be transferred from a channel constituted between two ribs into a channel constituted between two other ribs. In particular, the suspension comprising the liquid flow and the entrained solid particles in the intermediate region between aligned partial ribs of a rib can be transferred from a channel constituted between two ribs into a channel constituted between two further ribs. If, for example, a solid particle flows through the channel constituted between the first and second partial rib and comes into the unstructured intermediate region, a diversion of the flow direction of the solid particle can take place in this intermediate region, since said solid particle is no longer carried in a path defined by the channel. For example, it is possible for the solid particle to be diverted in such a way that it is now conveyed onwards in a channel constituted between the second aligned partial rib and the third aligned partial rib.

According to an embodiment of the invention, different partial regions with different flow velocities of the suspension comprising the liquid flow and the entrained solid particles are assigned to the guide rails of the size reduction device. The suspension flows through the partial regions in the flow direction one after the other. This suspension is conveyed into the size reduction device at an entrance velocity. In a first partial region comprising ribs, the cross-sectional area through which the suspension flows is smaller than the entrance region. According to the continuity equation (with retention of the mass) and the Navier-Stokes equation (amount of movement), an increased flow velocity of the suspension thus arises. When the suspension reaches the second partial region comprising no ribs, the flow velocity diminishes, because in this region the through-flow cross-section is increased.

Similar to the aforesaid, the flow velocity of the suspension increases upon entry into a following third partial region comprising ribs with an again reduced cross-sectional area and falls upon exit of the suspension from the size reduction device on account of an increased exit area. The flow velocity in the first partial region preferably corresponds approximately to the flow velocity in the third partial region and the entrance velocity of the suspension into the size reduction device preferably corresponds to the exit velocity of the suspension out of the size reduction device.

According to an embodiment of the invention, the partial ribs each comprise side faces parallel to the flow direction which are broadly constituted as isosceles triangles, wherein the base of the isosceles triangles is disposed on the base plate of the guide rail and wherein the tip of the triangle lying opposite the base and pointing in the direction of the size reduction means is preferably rounded off.

In their region adjacent to the unstructured intermediate region, the partial ribs are preferably constituted first more sharply inclined and then less sharply inclined towards the intermediate region, so that a broadly U-shaped valley is constituted between the two aligned partial ribs. As already described, the flow velocity of the suspension in the intermediate region is less than in the adjacent partial regions. The suspension thus remains longer in the intermediate region. In addition, the U-shape of the intermediate region promotes an eddy formation and turbulence, so that solid particles contained the suspension are repeatedly advanced towards the cutting elements of the size reduction means adjacent to the guide rail and undergo further size reduction by impact.

The ribs, in particular the aligned partial ribs, are disposed on a base plate of the guide rail in such a way that the corresponding channels for the suspension are constituted between the side of the base plate pointing towards the size reduction means and the side faces of the (partial) ribs. According to an embodiment of the invention, the side of the base plate pointing towards the size reduction means comprises a central recess. The latter is constituted in particular over the entire length of the base plate at right angles to the flow direction and parallel to the longitudinal axes of the shafts of the size reduction means. The central recess is preferably symmetrical with a central longitudinal axis parallel to the longitudinal axes of the shafts of the size reduction means. The central recess has, for example, the form of an isosceles trapezium, wherein the shorter base side of the trapezium forms the central region of the recess.

The longer base side of the trapezium preferably extends roughly between the points of intersection of the axes of symmetry of the broadly triangular partial ribs with their respective base. In particular, the vertex of the U-shaped valley constituted between two aligned partial ribs is identical to the centre point of the shorter base side of the trapezium.

The aligned partial ribs can for example each be identical to and mirror-symmetrical with a central longitudinal axis of the guide rail parallel to the longitudinal axes of the shafts. Furthermore, provision can be made such that the respective distance between the two triangular side faces of a partial rib narrows from the base in the direction of the tip, i.e. the thickness of the rib is greater in the region of the base face disposed on the base plate than the distance in the region of the rounded tip.

According to an embodiment of the size reduction device, the longitudinal axes of the shafts of the size reduction means are orientated vertical, i.e. upright, and the ribs of the guide rails are orientated horizontal. The respective uppermost and the lowest rib can in this case be constituted only as a single partial rib on the discharge side of the housing. Instead of an aligned partial rib on the introduction side, the unstructured intermediate region is constituted in a lengthened form. As a result of the assembly of the lower housing with the accommodation of the shaft bearing and sealing, there is a diversion rail integrated therein instead of the absent partial ribs, said diversion rail diverting the flow to the cutting elements. As a result of this design measure, a through-flow of larger solid particles in the region of the shaft seal can be prevented.

The invention also relates to a method for the size reduction of solid particles by means of a size reduction device. The solid particles are conveyed through the size reduction device as a suspension in a liquid flow. The suspension flows through at least two counter-rotatable size reduction means with cutting elements, wherein large solid particles are size-reduced. At least a part of the suspension with solid particles which do not exceed the maximum size can flow between one of the size reduction means and a guide rail. The suspension flows in particular through channels which are constituted between projecting ribs on the side of the guide rail that points towards the size reduction means. According to the invention, a second size reduction process takes place during the flow through the channels of the guide rail, in which process those solid particles are size-reduced which do not exceed a maximum size and thus can be conveyed through the channels.

The small solid particles are size-reduced in particular by the fact that eddies are formed at least in zones inside the suspension during the passage of the suspension between the size reduction means and the guide rail. The small solid particles entrained in the suspension are repeatedly advanced in this region towards the size reduction means and thus undergo further size reduction. This is especially possible when the flow velocity of the suspension is also reduced in the region of the eddy formation.

The invention relates in particular to the geometrical embodiment of ribbed guide rails of the size reduction device and the associated advantageous flow management and flow velocity (velocities) of the suspension conveyed through the size reduction device. The ribs of the guide rails are not constituted continuous, but comprise a central widening region, in which the solid particles of a suspension flowing through this region are retarded. Furthermore, an eddy formation preferably takes place in this central widened region. This eddy formation is used to guide the solid particles towards the side rails and repeatedly towards the cutting elements of the size reduction means.

Alternatively or in addition to the described features, the method can comprise one or more features and/or properties of the device described above. Alternatively or additionally, the device can also comprise individual or a plurality of features and/or properties of the described method.

The interaction of the special geometrical features of the guide rail, in particular an embodiment of the guide rail with a central unstructured U-shaped turbulence region, the different flow velocity zones and the two-part rib form including tapering of the partial ribs each constituted as a triangular shape leads to an advantageous flow behaviour of the solid particles contained in the suspension through the size reduction device and thus to an improved size reduction and homogenisation of the solid particles. It is in particular ensured that the part of the solid particles that is not passed directly between the two size reduction means, but rather passes by the latter at the side, is also particularly well size-reduced and is so as homogeneously as possible.

BRIEF DESCRIPTION OF THE DRAWINGS

Examples of embodiment of the invention and its advantages will be explained in greater detail below with the aid of the appended figures. The size ratios of the individual elements with respect to one another in the figures do not always correspond to the actual size ratios, since some forms are represented simplified and other forms are represented enlarged in relation to the other elements for the sake of better illustration.

FIGS. 1A-C show a size reduction device with lateral guide rails according to the prior art.

DETAILED DESCRIPTION OF THE INVENTION

Figure 2A:
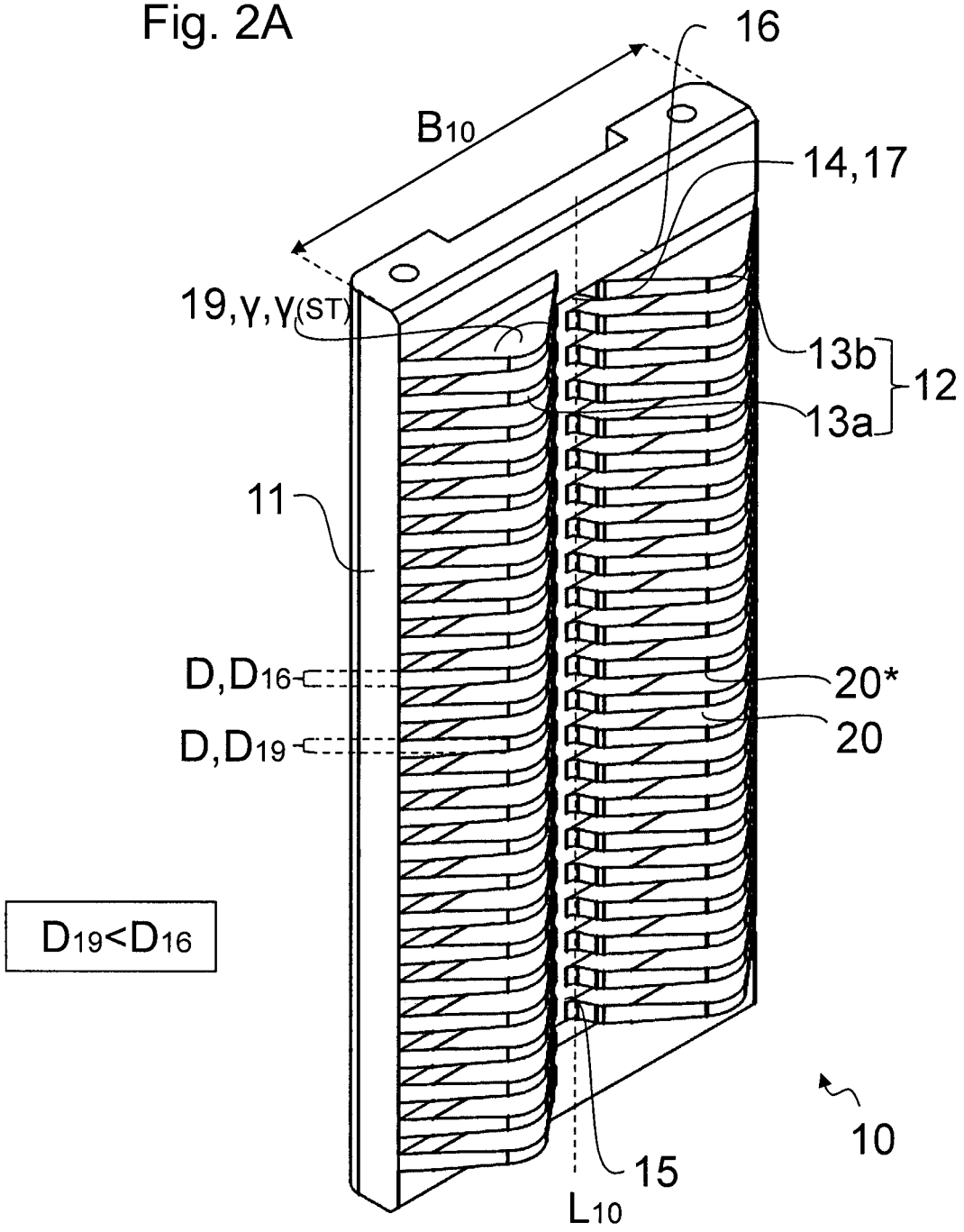
FIGS. 2A-E show in each case different representations of a guide rail according to the invention for a size reduction device.

Identical reference numbers are used for identical or identically acting elements of the invention. Furthermore, for the sake of a clearer view, only reference numbers are represented in the individual figures that are required for the description of the respective figure. The represented embodiments merely represent examples of how the device according to the invention or the method according to the invention can be embodied and do not represent a conclusive limitation.

FIG. 1 show a size reduction device 1 with lateral guide rails 7 according to the prior art. In particular, FIG. 1 shows a complete size reduction device 1, wherein the front side wall is not represented. This and the opposite side wall contain the inlet opening and respectively outlet opening for the suspension containing the solid particles. Two size reduction means 3 are disposed in housing 2 represented in cross-section. Said size reduction means each comprise a plurality of cutting discs 4, which are disposed as a stack upon one another. Cutting discs 4*a* of size reduction means 3*a* are disposed on a common shaft 5*a* and cutting discs 4*b* of size reduction means 3*b* are disposed of a second common shaft 5*b*. In the present case, second common shaft 5*b* is the drive shaft, which is driven by a drive, for example a motor M. First common shaft 5*a* is a driven or follower shaft 5*a*, which rotates around its longitudinal axis in the opposite direction with respect to shaft 5*b*.

Cutting discs 4 are each separated from one another by spacer elements 6, wherein spacer elements 6 preferably have the same thickness as cutting discs 4, so that spacer elements 6*a* of size reduction means 3*a* lie in the same plane as cutting discs 4*b* of size reduction means 3*b*. In this way, a cutting disc 4*a* of a size reduction means 3*a*, together with spacer element 6*b* of the other size reduction means 3*b*, forms a pair of size reduction members operating with one another.

Guide rails 7 are disposed in housing 2 at the side of size reduction means 3. Said guide rails can for example comprise triangular projections 7* at their opposite ends, said projections serving as diversion elements for diverting solid particles towards the front edges of the cutting teeth of cutting discs 4. An exemplary embodiment of a guide rail 7 known from the prior art is represented in FIG. 1B and FIG. 1C shows a cross-sectional representation through a size reduction device 1 according to FIG. 1A with a guide rail 7 according to FIG. 1B. Guide rail 7 comprises ribs 8, between which slots 9 are constituted. Ribs 8 and slots 9 extend parallel to the flow direction of the liquid with the solid particles to be sized-reduced. The side of ribs 8 that points towards size reduction means 3 is in each case constituted as a concave arch, in particular broadly in a form-fit manner with the external periphery of cutting discs 4 of size reduction means 3. Furthermore, guide rail 7 is disposed next to size reduction means 3, but at a certain distance from the latter, so that small solid particles can pass through, although the passage of large solid particles is not possible. Furthermore, the distance between ribs 8 of guide rail 7 is so small that the flow passage arising between ribs 8 prevents the passage of non-size-reduced waste material, but permits the passage of small solid particles of the solid waste with the through-flowing liquid. The non-size-reduced waste material is thus diverted and has to pass between the two size reduction means 3*a*, 3*b*, wherein it is suitably size-reduced.

FIG. 2 shows in each case different representations of a guide rail 10 according to the invention for a size reduction device 1 according to FIG. 1A. In particular, such a size reduction device 1 comprises in each case two mutually opposite guide rails 10, which lie adjacent to the rotating cutting mechanism comprising size reduction means 3*a* and 3*b* of a two-part size reduction device 1 (see FIG. 1). With a vertical arrangement to shafts 5*a*, 5*b* of size reduction means 3*a*, 3*b*, guide rails 10 are disposed between the upper and the lower part of housing 2. With a horizontal arrangement of shafts 5*a*, 5*b* of size reduction means 3*a*, 3*b*, a guide rail 10 is assigned to the upper side wall of housing 2 and a guide rail 10 is assigned to the lower side wall of housing 2. In particular, guide rails 10 are disposed at inner sides of housing 2 parallel to longitudinal axes $L_{5a}$, $L_{5b}$ of shafts 5*a*, 5*b* of size reduction means 3*a*, 3*b* (see also FIG. 1).

Figure 2B:
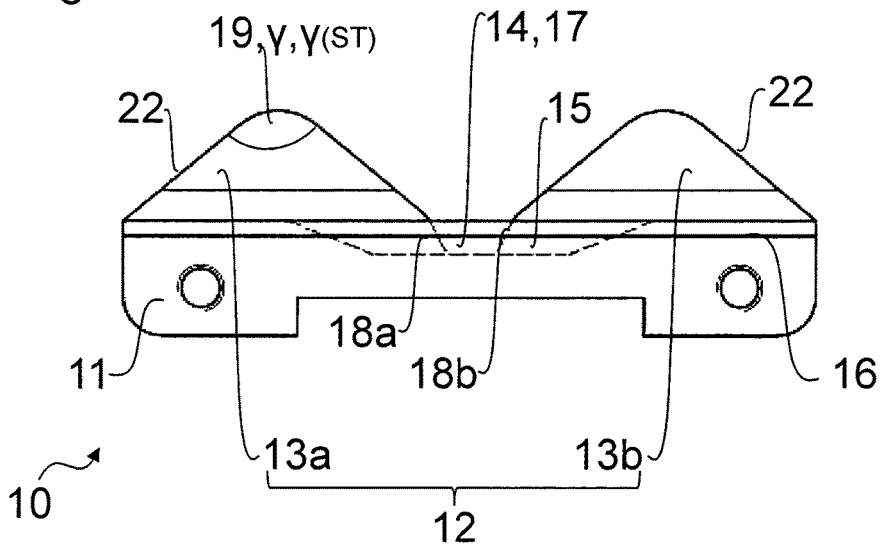
Figure 2C:
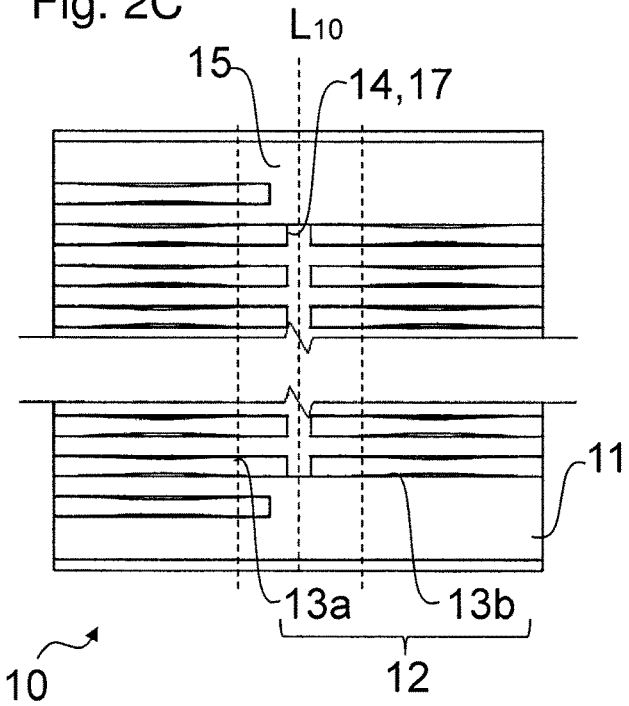
Figure 2D:
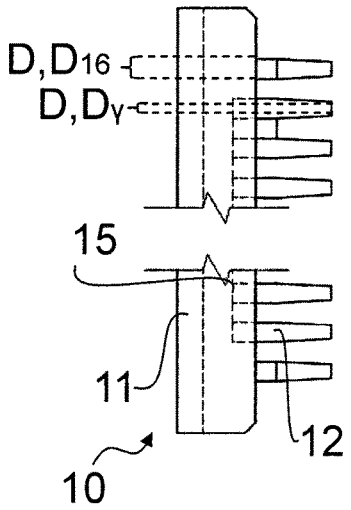

FIG. 2A show as a perspective view of a guide rail 10, FIG. 2B shows a plan view, FIG. 2C shows a view from in front and FIG. 2D shows a side view.

Guide rails 10 also comprise ribs 12, which—similar to the prior art—serve to ensure that the flow passage arising between ribs 12 prevents the passage of non-size-reduced solid particles, but permits the passage of small solid particles with the through-flowing liquid. The through-flow of the liquid is thus increased and at the same time the size reduction effect is increased.

In contrast with the prior art represented in FIG. 1, however, ribs 12 comprise a number of structural differences. In particular, their geometrical shape displays the following properties: ribs 12 are not constituted continuous over the entire width $B_{10}$ of guide rail 10, but rather are each divided into two partial ribs 13*a*, 13*b* with a so-called rib-free central region 14.

The totality of all partial ribs 13*a* constituted mountain-like forms a first mountain chain and the totality of all mountain-like partial ribs 13*b* forms a second mountain chain. A valley is constituted between the latter by the totality of all rib-free central regions 14, said valley essentially extending along a central longitudinal axis $L_{10}$ of the guide rail parallel to longitudinal axes $L_{5a}$, $L_{5b}$ of shafts 5*a*, 5*b* of size reduction means 3*a*, 3*b* (see also FIG. 1).

Furthermore, base plate 11 of guide rail 10, on which ribs 12 are disposed, comprises a central recess 15 parallel to longitudinal axes $L_{5a}$, $L_{5b}$ of shafts 5*a*, 5*b* of size reduction means 3*a*, 3*b* (see also FIG. 1). Rib-free central region 14 between aligned partial ribs 13*a*, 13*b* forming a rib 12 is in each case disposed in particular in central recess 15 of base plate 11. As will be explained in greater detail in connection with FIG. 3, rib-free central region 14 forms a turbulence zone with a lower flow velocity v3, in which solid particles 30 are size-reduced by impact against the rotating cutting edges of cutting discs 4 (see FIGS. 1 and 4).

Furthermore, ribs 12 comprise a symmetrical lateral bevel on both sides for exerting a directional influence on the solid particles in the liquid flow onto partial sections. Partial ribs 13*a*, 13*b* have in particular a broadly isosceles triangle shape, wherein base 16 of the triangle is assigned to base plate 11 and tip 19 lying opposite the base has an angle $\gamma$, preferably a rounded-off obtuse angle $\gamma_{(ST)}$.

Figure 2E:
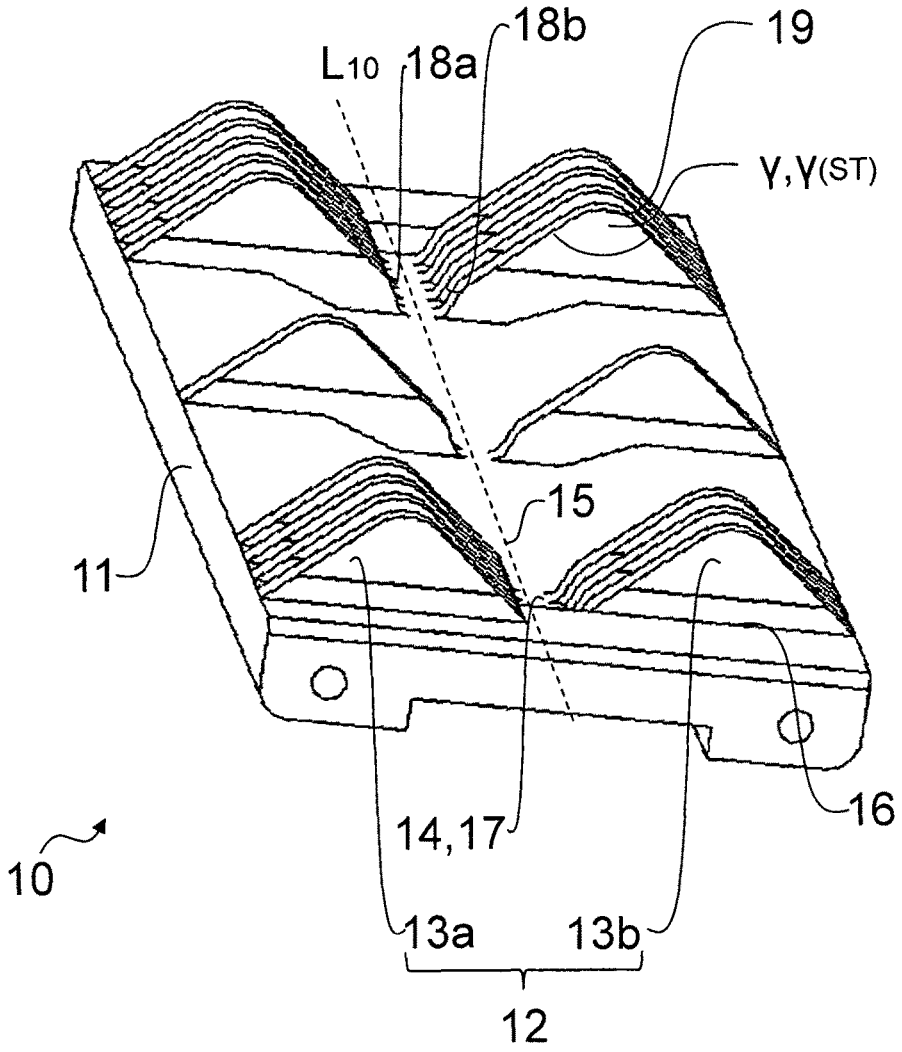

As can also be seen in particular in FIGS. 2A, 2D and 2E, partial ribs 13*a*, 13*b* of ribs 12 narrow from base 16 of partial ribs 13*a*, 13*b* in the region of base plate 11 towards their rounded tip 19. This means that thickness $D_{16}$ in the region of base 16 is greater than thickness $D_{19}$ in the region of tip 19.

Furthermore, partial ribs 13*a*, 13*b* are constituted first more sharply and then less sharply inclined in their region 18*a*, 18*b* adjacent to central region 14, so that a U-shaped valley 17 is constituted in each case between the two aligned partial ribs 13*a*, 13*b* of a rib 12.

FIG. 3 show in each case diagrammatically the passage of the suspension with solid particles in flow direction SR in various representations of a guide rail 10 according to the invention according to FIG. 2. Flow velocities v are represented pictorially in particular in FIG. 3.

Figure 4:
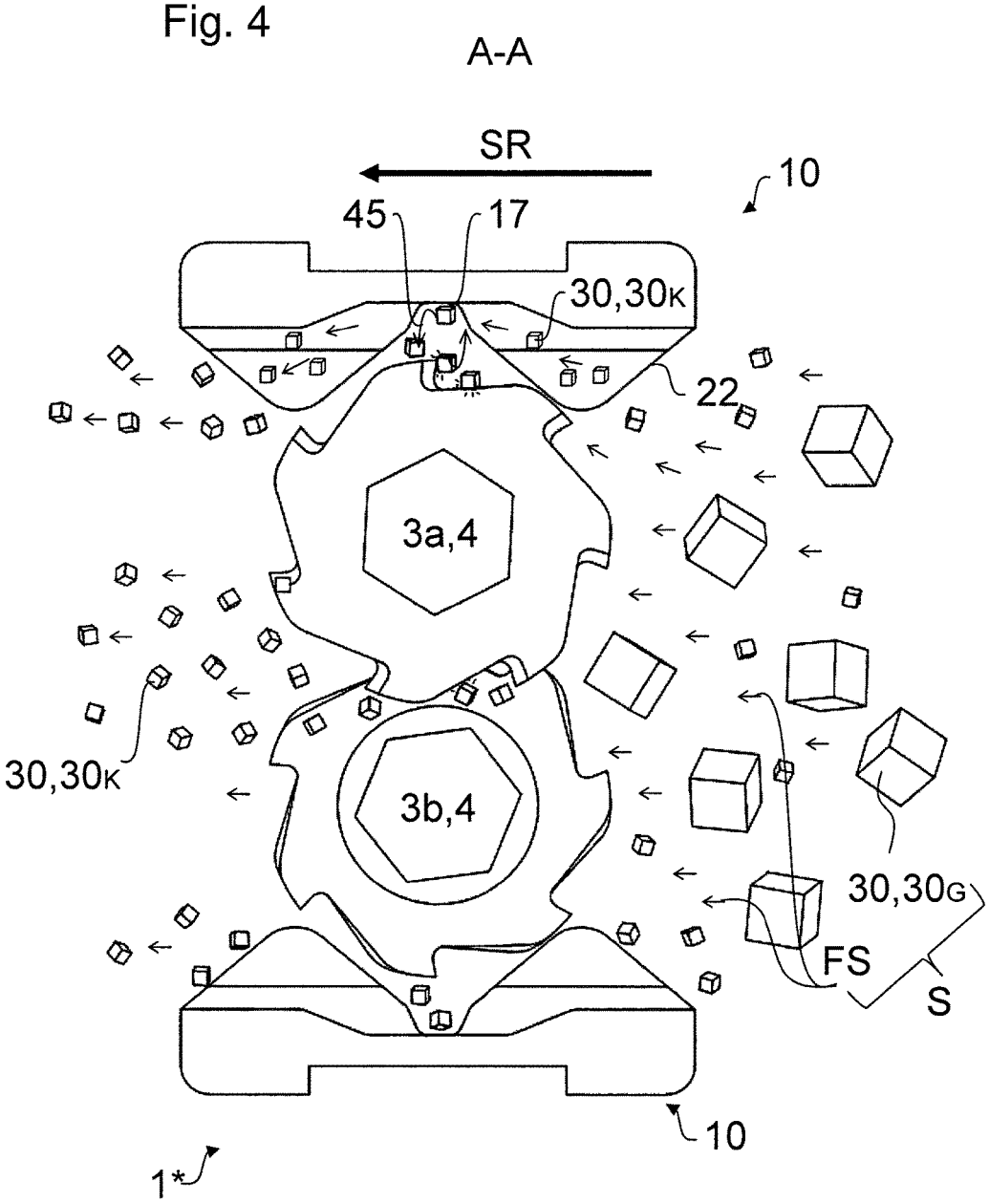
FIG. 4 shows a cross-section A-A (similar to FIG. 1) through a size reduction device with guide rails according to the invention.

FIG. 4 shows a cross-section A-A (similar to FIG. 1) through a size reduction device 1* with guide rails 10 according to the invention, in particular the arrangement of two size reduction means 3*a*, 3*b* between two guide rails 10 according to the invention. Solid particles 30, $\mathbf{30}_G$ to be size-reduced are conveyed as suspension S in a liquid flow FS through size reduction device 1*.

Constituted between adjacent ribs 12 of a guide rail 10 is a channel 20, into which only small solid particles $\mathbf{30}_K$ with a defined maximum size can enter. Larger solid particles $\mathbf{30}_G$ are directed back into the main liquid flow and thus between cutting discs 4 of size reduction means 3*a*, 3*b*. The flow line of a small solid particle $\mathbf{30}_K$, which enters into a channel 20 constituted between two adjacent ribs 12, tends to follow the geometrical profile of ribs 12.

As already described in connection with FIG. 2, the profile structure of each partial region 13*a*, 13*b* of ribs 12 makes provision such that thickness D of partial ribs 13*a*, 13*b* narrows, starting from base 16 at the lateral parts towards the rib height or rounded tip 19. The cross-sectional area of the flow or of channel 20 narrowing towards base 16 of ribs 12 makes it possible for smaller solid particles $\mathbf{30}_K$ to follow liquid flow FS without problem. On the other hand, the cross-sectional area of channel 20 widens at tips 19 of partial ribs 13*a*, 13*b*. This causes a locally raised flow velocity v+ in the immediate proximity of rotating cutting discs 4 (see in particular FIGS. 3A and 4), the effect of which is that larger solid particles $\mathbf{30}_G$ in flow channel 20 pass almost inevitably into the cutting mechanism of size reduction device 1* constituted by size reduction means 3*a*, 3*b*.

The flow line also follows the profile because the side walls of partial ribs 13*a*, 13*b* each have a tendency to reduce the wall thickness or thickness D of partial ribs 13*a*, 13*b* of ribs 12, and because, in a flow field, the flow line is always tangential to flow direction SR at an arbitrary point of the field. In central region 14 of rib 12, in which ribs 12 are not constituted continuous, small solid particle $\mathbf{30}_K$ experiences different changes in flow direction SR. A flow region with an increased degree of freedom is found in central region 14. Small solid particle $\mathbf{30}_K$, which is constrained to be transported onwards in flow channel 20 of a rib 12 on the same side of partial ribs 13*a*, 13*b*, can however also switch in central region 14, by means of a brief change in flow direction SR into a flow direction SR1, from one side of partial region 13*b* to the other side of aligned partial region 13*a* of the same rib 12. Solid particle $\mathbf{30}_K$ can thus change in central region 14 into different directions preferably at an acute angle $\alpha$ to flow direction SR into other channels 20.

Since the flow velocity in channels 20 between partial ribs 13*a*, 13*b* of ribs 20 is, viewed relatively, higher than outside size reduction means 3*a*, 3*b* and since solid particle $\mathbf{30}_K$ has a relatively small mass, as a result of which the influence of gravity is almost negligible, solid particle $\mathbf{30}_K$ can change, on account of turbulent flow SR2, also into channels 20* of guide rail 10 at a higher level (see also FIG. 2A in connection with an arrangement according to FIG. 1A).

Figure 3A:
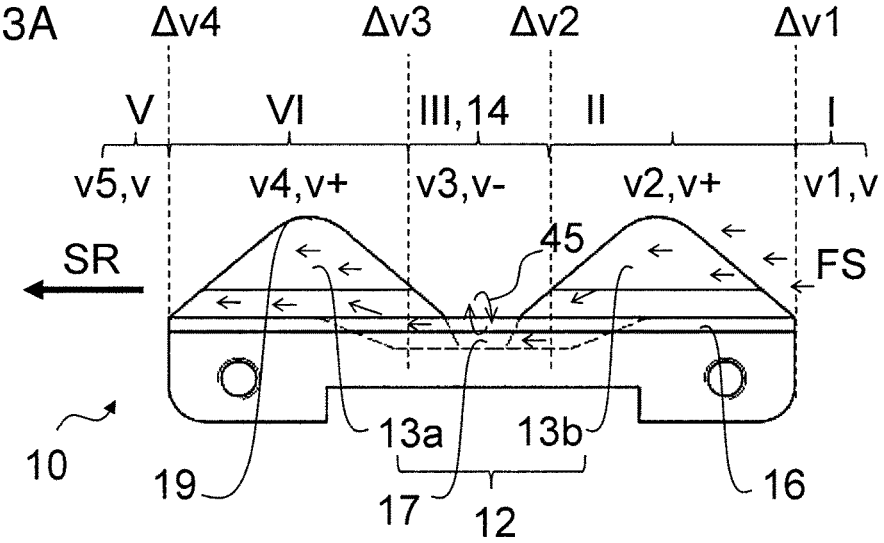
FIGS. 3A-D show in each case diagrammatically the through-flow of the suspension in the various representations of a guide rail according to the invention according to FIG. 2.
Figure 3B:
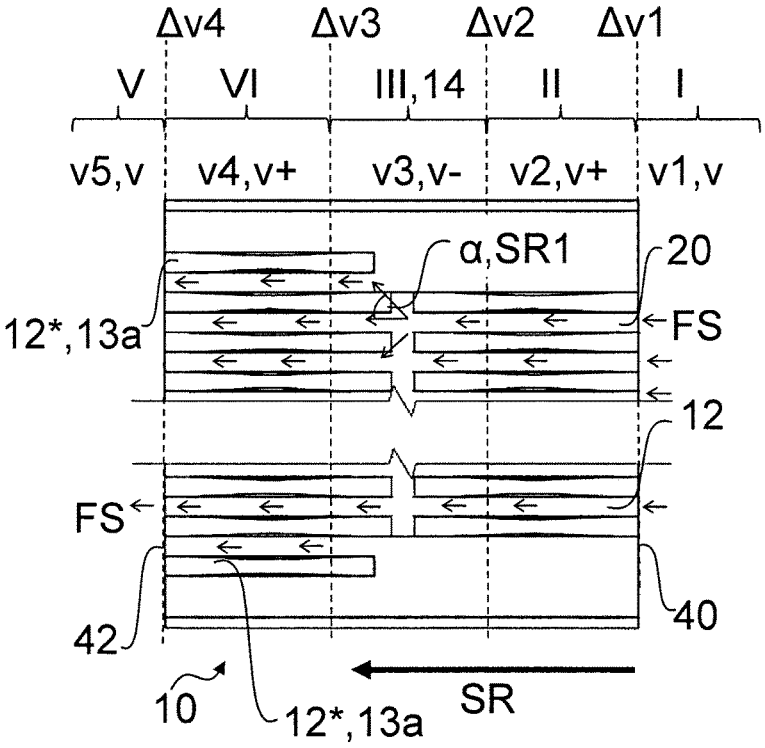
Figure 3C:
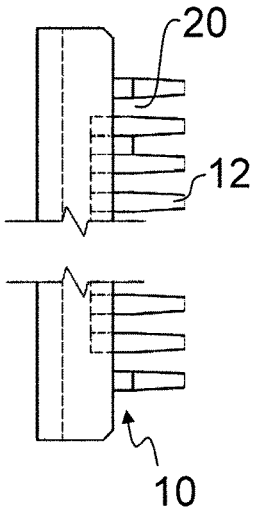

In particular, four velocity changes $\Delta v$ can be ascertained in the control volume, which comprises the section from entrance edge 40 to exit edge 42 of guide rail 10 including all ribs 12 present therein. These are illustrated in FIG. 3B.

A first velocity change $\Delta v1$ from v1 to v2 occurs with the entry into a section II, in which channels 20 are constituted between partial ribs 13*b* of ribs 12 which are parallel to flow direction SR. When account is taken of the continuity equation (with retention of the mass) with $$v1 \times \text{cross-sectional area of the inflowing suspension in section } I = v2 \times \text{cross-sectional area of channel 20 in section } II$$

and the Navier-Stokes equation (amount of movement), it is then possible to resolve the latter according to the velocity field and the pressure field. The available area is thus reduced and the velocity is correspondingly increased, i.e. flow velocity v2 in section II is greater than flow velocity v1 in section I. After passage through section II, partial ribs 13*b* of ribs 12 end and the suspension passes into section III, which in particular comprises central region 14 between aligned partial ribs 13*a*, 13*b* of a rib 12. The suspension experiences here a second change of velocity Δv2 from v2 to v3. With the change of velocity Δv2, velocity v2 of the suspension is reduced to velocity v3, since the cross-section of the through-flow is increased again.

When the suspension enters into following section IV into channels 20 between partial ribs 13*a* of ribs 12, the velocity changes again. With the change in velocity Δv3 from v3 to v4, the flow velocity in turn increases, wherein velocity v4 in section IV tends to correspond roughly to velocity v2 in section II. When the suspension then finally exits from channels 20 formed by ribs 12, exit velocity v5 of size reduction device 1* (see FIG. 4) is established, with the change in velocity Δv4, at a lower velocity than v4.

The embodiment of partial ribs 13*a*, 13*b* in regions 18*a*, 18*b* adjacent to central region 14 (see FIGS. 2A and 2F) leads to the formation of a U-shaped recess in central region 14, in particular a U-valley 17. In particular, this is also assisted by a central recess 15 of the base plate of guide rail 10 indicated in FIG. 2E. Eddies 45 are formed in the U-shaped recess in central region 14 on account of flow velocity v3 and the flow properties of the suspension. U-shaped valley 17 initiates the formation of eddies 45 taking account of the flow forces, the surface tension and the entrainment effect, which then in turn causes turbulence and increases the probability of solid particles 30, $\mathbf{30}_K$ entrained in the suspension being repeatedly advanced towards cutting discs 4.

The invention is based on the use of the mechanical flow properties, in order thus to generate a zone for an additional size reduction of solid particles 30, $\mathbf{30}_K$. An improvement in the basic size reduction properties of the currently available double-shaft size reduction devices is thus intended to be achieved. In principle, a corresponding adaptation of the guide rail also to multi-shaft size reduction devices is conceivable.

The first size reduction process takes place as soon as solid particles 30, $\mathbf{30}_G$, $\mathbf{30}_K$ enter into the suction region of size reduction device 1* and are diverted there in the direction of cutting discs 4 on account of laterally bevelled partial rib 13*b*, in particular along the equilateral side 22. When solid particles 30, $\mathbf{30}_G$, $\mathbf{30}_K$ then flow along, following flow direction SR, in channels 20 between partial ribs 13*a*, 13*b* of ribs 12, flow velocity v2 in partial section II, i.e. before reaching central region 14 of ribs 12, increases. As soon as the suspension has reached central region 14 between aligned partial ribs 13*a*, 13*b* of a rib 12, its flow velocity v3 diminishes on account of the increased cross-sectional area. In addition, this shaping stimulates the formation of eddies 45.

Solid particles 30, $\mathbf{30}_K$ entrained in the suspension tend under these conditions to be fed in central region 14 more often towards cutting discs 4. A secondary cutting process or size reduction process is thus enabled, which in fact is an impact with the cutting edges of cutting discs 4 and brings about a further size reduction of solid particles 30, $\mathbf{30}_K$. Solid particles 30, $\mathbf{30}_K$ then pass into partial section IV, in which channels 20 are again constituted between partial ribs 13*a* of ribs 12, after which they then completely leave the size reducer.

Figure 3D:
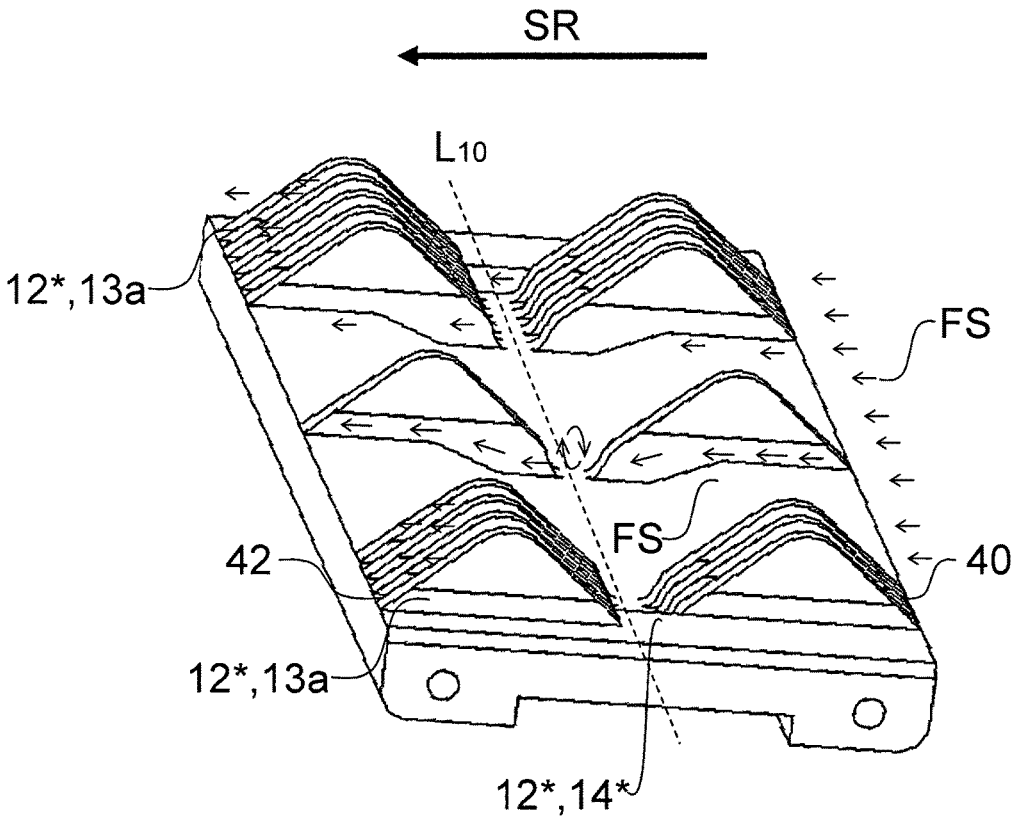

Especially in FIGS. 3B and 3D, it can also be seen that uppermost and lowest rib 12* in each case comprise only one partial region 13*a* with adjacent lengthened central region 14*. In particular, uppermost and lowest rib 12* do not comprise any partial regions 13*b* aligned with partial region 13*a*. As a result of this design measure, a passage of larger solid particles is prevented in the region of the shaft seal.

The invention has been described by reference to a preferred embodiment. The person skilled in the art can however envisage that modifications or changes can be made to the invention without thereby departing from the scope of protection of the following claims.

LIST OF REFERENCE NUMBERS

1 Size reduction device
2 Housing
3 Size reduction means
4 Cutting disc
5 Shaft
6 Spacer element
7 Guide rail
7* Projection
8 Rib
9 Slot
10 Guide rail
11 Base plate
12 Rib
13 Partial rib
14 Central region
15 Central recess
16 Base
17 U-valley
18 Region adjacent to the central region
19 Tip
20 Channel
22 Side
30 Solid particle
40 Entrance edge
42 Exit edge
45 Eddy
α Angle
B Width
D Thickness
Δv Change in velocity
FS Liquid flow
γ Angle
L Longitudinal axis
S Suspension
SR Flow direction
v Velocity
I (partial) section
II (partial) section
III (partial) section
IV (partial) section
V (partial) section

What is claimed is:

1. A size reduction device for solid particles conveyed as a suspension in a liquid flow through the size reduction device, the size reduction device comprising:

a housing which is at least partially open at opposite sides for the purpose of introducing and discharging the suspension in a flow direction;

at least two counter-rotatable size reduction components disposed in the housing, wherein each size reduction component comprises a plurality of cutting elements, which are each disposed on a common rotatable shaft, wherein each shaft has a longitudinal axis, wherein the flow direction of the suspension is at right angles to the longitudinal axes of the shafts of the size reduction means;

two mutually opposite guide rails with in each case a longitudinal axis parallel to the longitudinal axes of the shafts of the size reduction means are assigned to the size reduction means, wherein each guide rail comprises a base plate, on which ribs with channels lying in between are constituted parallel to the flow direction on a side of said base plate that points towards the size reduction means, wherein the liquid flow and the solid particles entrained therein having a maximum size predetermined by the width of the channel can be conveyed through the channels, and wherein the ribs each cover only a partial region of a width of the guide rails parallel to the flow direction.

2. The size reduction device according to claim 1, wherein the ribs each comprise two aligned partial ribs, wherein a central, essentially unstructured intermediate region is constituted between aligned partial ribs, in which central region a second size reduction process of small solid particles takes place.

3. The size reduction device according to claim 2, wherein the partial ribs each comprise side faces parallel to the flow direction which are broadly constituted as isosceles triangles, wherein the base of the isosceles triangles is disposed on the base plate of the guide rail and wherein the tip of the triangle lying opposite the base and pointing in the direction of the size reduction means is rounded off.

4. The size reduction device according to claim 3, wherein the partial ribs are each constituted, in their region lying adjacent to the intermediate region, first more sharply and then less sharply inclined towards the intermediate region, so that a broadly U-shaped valley is constituted in the intermediate region between the two aligned partial ribs.

5. The size reduction device according to claim 4, wherein the base plate of the guide rail comprises a central recess symmetrical with a central longitudinal axis of the guide rail parallel to the longitudinal axes of the shafts of the size reduction means, and wherein the cross-sectional area of the central recess has the shape of an isosceles trapezium, wherein the shorter base side of the trapezium forms the central region of the recess.

6. The size reduction device according to claim 5, wherein the vertex of the U-shaped valley is identical to the center point of the shorter base side of the trapezium.

7. The size reduction device according to claim 3, wherein the aligned partial ribs are constituted mirror-symmetrical with the central longitudinal axis of the guide rail parallel to the longitudinal axes of the shafts.

8. The size reduction device according to claim 3, wherein the respective distance between the two triangular side faces of a partial rib narrows from the base in the direction of the tip.

9. The size reduction device according to claim 2, wherein the longitudinal axes of the shafts of the size reduction means are orientated vertical and the ribs of the guide rails are orientated horizontal and wherein the respective uppermost and the lowest rib comprises only one partial rib on the discharge side of the housing and comprises a lengthened essentially unstructured intermediate region in the region of the introduction side.

10. The size reduction device according to claim 1, wherein a valley between the totality of the aligned partial ribs of a guide rail is constituted in a central region of the guide rails parallel to the longitudinal axes of the shafts of the size reduction means.

11. The size reduction device according to claim 1, wherein the liquid flow and solid particles entrained in the liquid flow which do not exceed a maximum size, in the partial region of the width of the guide rails not covered by ribs, can be transferred from a channel constituted between two ribs into a channel constituted between two other ribs, and wherein the suspension comprising liquid flow and entrained solid particles, in the intermediate region between aligned partial ribs of a rib, can be transferred from a channel constituted between two ribs into another channel constituted between two ribs.

12. The size reduction device according to claim 1, wherein different partial regions with different flow velocities of the suspension comprising liquid flow and entrained solid particles are assigned to the guide rails of the size reduction device, wherein the suspension flows through the partial regions one after the other in the flow direction, and wherein, in a first partial region comprising ribs, the cross-sectional area through which the suspension flows is reduced and the flow velocity of the suspension is increased compared to an entrance velocity of the suspension into the size reduction device, wherein, in a second partial region comprising no ribs, a cross-sectional area through which the suspension flows is increased compared to the cross-sectional area in the first partial region and the flow velocity of the suspension is reduced compared to the flow velocity in the first partial region, wherein, in a third partial region comprising ribs, a cross-sectional area through which the suspension flows is reduced compared to the cross-sectional area in the second partial region and the flow velocity of the suspension is increased compared to the flow velocity in the second partial region and wherein a cross-sectional area through which the suspension flows is increased compared to the cross-sectional area in the third partial region and the exit velocity of the suspension from the size reduction device is reduced compared to the flow velocity in the third partial region, and wherein the flow velocity in the first partial region roughly corresponds to the flow velocity in the third partial region.

* * * * *